United States Patent [19]

Takahashi et al.

[11] Patent Number: 4,780,742

[45] Date of Patent: Oct. 25, 1988

[54] IMAGE QUALITY IMPROVING PROCESS AND APPARATUS AND SHEET USABLE THEREWITH

[75] Inventors: Yasushi Takahashi, Kawasaki; Takashi Saito, Ichikawa, both of Japan

[73] Assignee: Canon Kabushiki Kaisha, Tokyo, Japan

[21] Appl. No.: 758,789

[22] Filed: Jul. 25, 1985

[30] Foreign Application Priority Data

| | | | |
|---|---|---|---|
| Jul. 30, 1984 | [JP] | Japan | 59-157179 |
| Jul. 30, 1984 | [JP] | Japan | 59-157180 |
| Nov. 19, 1984 | [JP] | Japan | 59-243911 |
| Nov. 19, 1984 | [JP] | Japan | 59-243912 |
| Nov. 19, 1984 | [JP] | Japan | 59-243913 |
| Dec. 25, 1984 | [JP] | Japan | 59-275547 |

[51] Int. Cl.[4] ..... G03G 15/20; G03G 21/00

[52] U.S. Cl. ..... 355/3 FU; 156/323; 219/216; 355/14 FU; 430/124; 432/60

[58] Field of Search ..... 355/3 R, 3 FU, 14 FU, 355/72; 219/216, 469, 470, 471; 156/323, 555; 162/271; 432/60, 59; 430/98, 99, 124; 250/316.1, 317.1, 318, 319

[56] References Cited

U.S. PATENT DOCUMENTS

| | | | |
|---|---|---|---|
| 3,066,679 | 12/1962 | Hurley et al. | 250/317.1 X |
| 3,129,328 | 4/1964 | Wedel | 250/319 |
| 3,170,395 | 2/1965 | Gundlach et al. | 250/317.1 X |
| 3,283,126 | 11/1966 | Velvel | 219/216 X |
| 3,716,018 | 2/1973 | Ohta et al. | 355/3 FU X |
| 3,788,930 | 1/1974 | Honjo et al. | 430/124 X |
| 3,813,267 | 5/1974 | Honjo et al. | 430/99 X |
| 3,934,256 | 1/1976 | Isonaka et al. | 355/72 X |

FOREIGN PATENT DOCUMENTS

| | | | |
|---|---|---|---|
| 57-85070 | 5/1982 | Japan | 355/14 FU |

*Primary Examiner*—Fred L. Braun

*Attorney, Agent, or Firm*—Fitzpatrick, Cella, Harper & Scinto

[57] ABSTRACT

An apparatus, a process and a processing sheet for improving qualities of an image in sharpness, density and/or glossiness. A copy or printed sheet having an image is coated with a thin sheet at the image bearing side of the copy. The copy is then pressed together with the thin sheet, and simultaneously heated so as to soften or fuse at least the surface of the image on the copy. Then, the sheet is peeled off the image after the image is cooled sufficiently. Surprisingly, the qualities of the image are improved as compared with the image before processing.

18 Claims, 9 Drawing Sheets

IMAGE QUALITY IMPROVING PROCESS AND APPARATUS AND SHEET USABLE THEREWITH

FIELD OF THE INVENTION AND RELATED ART

The present invention relates to a process and apparatus for processing a fixed, partly fixed or unfixed toner image and a sheet usable with the process and the apparatus.

Many of conventional image forming machines such as copying machines and printers produce an image in the form of a toner image, which is fixed on a recording material such as paper or resin sheet, wherein the paper or the sheet having the fixed image is discharged out of the image forming machine as an output thereof For the purpose of fixing the toner image, a fixing device is generally used in which the toner image is fixed on the paper or the resin sheet by heat, by pressure or by heat and pressure. Recently, a home-use type of such a machine has become popular, and the image recording speed thereof ranges between 120–20 per minute (A4 size sheet).

As for the color of the image to be formed, many colors are used, so that black, red, blue and green toner particles are available as desired. As for the recording material on which the image is to be formed, many types are used such as plain paper for office use, second original paper for drawings and a resin film. A smaller size sheet such as name cards and post cards are also used.

The wider variations of the used toner particles and used recording materials lead to variations in the image fixing performance. To meet such variations, some proposals have been made and put into practice. However, the image produced by the fixing device having improved performance is still less beautiful than the original More particularly, the produced image is less sharp and has a lower image density than the original. Among the output productions of the image forming apparatus, Christmas cards, New Year cards, invitation cards, greeting cards, menus of restaurants, tickets and certificates of merit require sharp and properly glossy images of high image density. However, the conventional fixed images do not satisfy those requirements.

In addition, the image formation technique is required to be adaptable to a wide range of uses such as a digital image and color image. Among such variations, it has already been practiced and has become popular that an image is formed on a transparent film with black or, other color toner particles (hereinafter will be called "transparent copy"), and is projected on a screen by an overhead projector (OHP). When, however, the transparent copy is produced by an electrophotographic machine or the like, the projected image is like a black or gray image even if the image is formed by non-black toner. This is because the toner is less transparent and/or because the surface of the image is so rough that the light is scattered or diffusedly reflected, with the result that the light incident on the toner image cannot reach the screen, and therefore, the toner image part is reproduced on the screen as a non-transparent part, that is, black. In the conventional image fixing method, the toner image on the transparent film can be partly adhered to the surface of a heating roller, and it can be transferred back to the transparent film, thus contaminating the image surface, and in addition, the roughness is not removed from the image surface so that it is considered that the non-black image is not properly reproduced on the screen.

SUMMARY OF THE INVENTION

Accordingly, it is a principal object of the present invention to provide an image quality improving process and apparatus therefor by which provides high quality, sharpness and beauty of the image unlike conventional devices.

It is another object of the present invention to provide an image quality improving process and an apparatus therefor which provides improvement in a quality of a fixed image produced by pressure-fixing, heat-fixing or pressure-heat-fixing a toner image formed on a recording material by a printing, an electrophotographic or an electrostatic process.

It is a further object of the present invention to provide an image quality improving process and an apparatus therefor by which the quality of an image formed by a certain image forming apparatus is improved.

It is a further object of the present invention to provide a process and an apparatus for improving a quality of an image (unfixed, partly fixed or completely fixed image) produced by a printer or a copying machine.

It is a further object of the present invention to provide a recording material processing sheet usable for improving image quality.

It is a further object of the present invention to provide an image quality improving process and an apparatus by which the color reproducibility in a projected image is improved when the transparent copy is produced by an electrophotographic process or the like.

It is a further object of the present invention to provide a recording material processing sheet by which a properly transparent image is formed on the transparent film.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
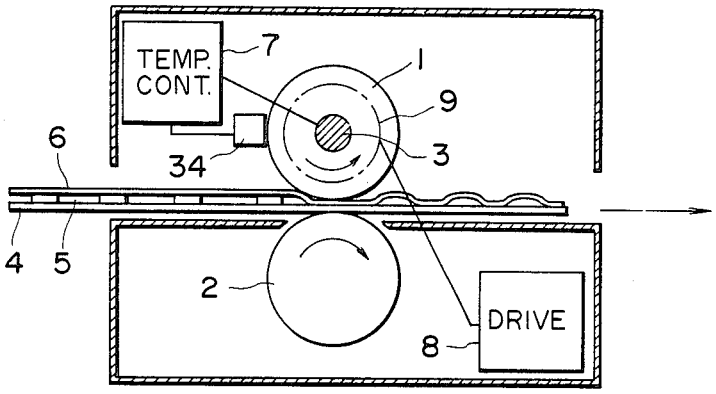
FIG. 1 is an image quality improving apparatus according to an embodiment of the present invention.

Referring to FIG. 1, there is shown an image quality improving apparatus according to an embodiment of the present invention, wherein a couple of rollers 1 and 2 (a first rotatable member and a second rotatable member), which are press-contacted to each other by an unshown pressing means, forms a nip therebetween. Within the roller 1, a heater 3 is provided which is controlled by temperature control means 7 responsive to the surface temperature of the roller 1 detected by a temperature sensor 34. The control means 7 is effective to maintain the surface temperature of the roller 1 at a level not less than the softening point of the toner constituting an image 5. The roller 1 is provided with a gear 9 which is driven by driving means 8. The roller 1 may be driven only when necessary or may be always driven, including the stand-by period.

The recording material has on a surface thereof a toner image which may be an unfixed, partly fixed or completely fixed image. The image bearing side of the recordng material is covered or coated with a thin processing sheet which is closely contacted to the image bearing side thereof. The recording material thus coated is passed through the nip so that the image is pressed between the processing sheet and the recording material under the application of proper pressure and heat sufficient to soften the toner image.

Figure 2:
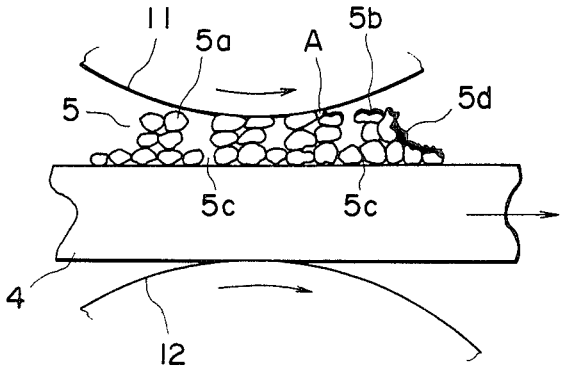
FIG. 2 PRIOR ART
FIG. 2 is an enlarged sectional view of an image produced by a conventional method.

FIG. 2 shows an enlarged sectional view of an image itself in the process of being fixed by a conventional image fixing device, wherein the recording material is usually pressed and heated between fixing rollers 11 and 12, thus fixing the toner image 5 on the recording material 4. Since it relatively often happens that sufficient pressure and/or heat is not applied over the entire area or that a part of the toner image is adhered to the fixing roller 11 which is in contact with the image, the toner particles 5*a* are not sufficiently joined with one another, with the result of cavities 5*c* remaining the toner particles 5*a*, as shown in FIG. 2. With such cavities, the image density is decreased because the cavities allow the light reflected by the recording material to pass and allow the light transmitting through the recording material to pass through. Furthermore, the edge portion 5*d* of the toner image is not sharp, and this is the cause of the image giving the impression of a coarse image. More importantly, at the separating portion A where the surface of the fixing roller 11 is separated from the toner image 5, and where the toner is fused by the highest temperature in the fused portion of the toner image, the surface of the toner image is finely roughened after the separation, as indicated by reference 5*b*. The resultant surface roughness diffusedly reflects the incident light so that the image is hardly glossy. It is speculated that the surface roughness is caused by a condensing force produced upon abrupt cooling of the binder in the toner image. It has been found that even if the toner particles are fused by sufficient heat and pressure to such an extent that they are joined to be integral, the surface roughness 5*b* is still created.

Figure 3:
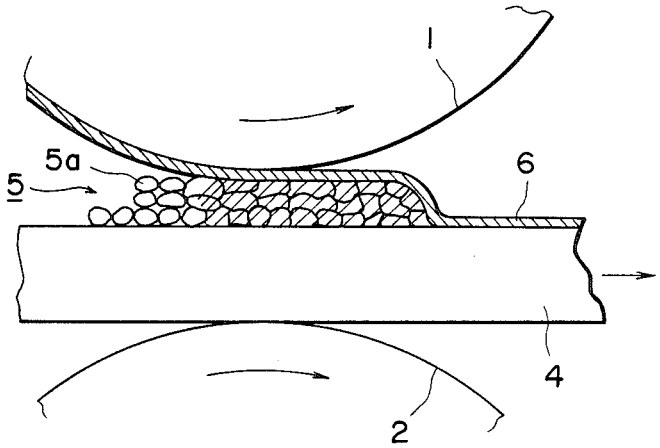
FIG. 3 illustrates the function of the apparatus according to an embodiment of the present invention.

FIG. 3 illustrates the operation of the image quality improving apparatus according to the embodiment of the present invention shown in FIG. 1. With this apparatus, the surface roughness of the image can be removed. The rollers 1 nd 2 can apply the pressure and temperature such that at least the surface of the image 5 is fused or softened. The recording material 4 and the image 5 carried thereon, when passed through the nip in the direction shown by the arrow, are covered or coated by the processing sheet 6 and heated and pressed. Since the processing sheet 6 is thin and flexible, it is uniformly close-contacted to the recording material 4 and the image 5. Therefore, the hatched portion of the toner image 5, in FIG. 3, is packed by the sheet 6, with the result that the toner particles 5*a* are fused and joined to be integral. Because of this, the surface of the image is smoothed, and the image is made sharp with the aid of the condensing tendency of the toner particles. In addition, the image density is increased to approx. 1.5 times. After this processing by the processing sheet 6, the image is cooled, and then the processing sheet 6 is peeled off the image surface. As a result, an image of improved quality is provided.

In the apparatus shown in FIG. 1, the processing sheet 6 is needed only in the nip between the rollers 1 and 2, including a portion slightly downstream of the nip. From this standpoint, the processing sheet 6 is temporarily necessary not permanently required.

In the apparatus of FIG. 1, a transparent film, that is, a transparent resin sheet for an overhead projector may be used as the recording material 4. In this case, the processing thin sheet 6 is preferably thinner than the transparent film. Furthermore, the thin film 6 is preferably provided with a smooth surface at the side thereof contactable with the image, and it preferably has a sufficient flexibility to follow the pattern of the image which is in the form of a step on the recording material surface.

When the image 5 is formed with non-black color toner, the apparatus of the present invention wherein the recording material 4 is passed through the nip together with a thin film 6, is advantageous in that the toner image becomes more transparent because of the phase-addition of the binder, pigment and dye contained in the toner, in addition to the removal of the surface roughness of the toner image. Therefore, a fine and sharp color image may be projected on the screen.

As for the material and the thickness of the transparent film 4, a polyester film of 12–200 5 microns thickness, for example, is usable, but 50–120 microns of the same material is preferable since it is easy to handle.

As for the material of the thin film 6, it is preferable to have a heat resistive property and to have such a property that the phase-solution bonding with toner does not easily occur under the heat. When the recording material is of paper, the film 6 may be made of resin.

More particularly, the thin film 6 may be a polyester film or polyimide film having a thickness not more than 50 microns if these are used, the image on the transparent film 4 is not transferred to the film 6 irrespective of the way of peeling of the film from the image. When another film is used, the preferable range of the thickness is determined by one of ordinary skill in the art in view of the material of the film. In any event, a film of thickness not more than 50 microns is desirable, provided that the above-described requirements are satisfied.

The rollers 1 and 2 are of metal rubber and/or other suitable materials, and the number of rollers may be two or three or more. The heat source may be provided in association with the roller contactable with the toner image side or may be provided in association with each of the plural rollers The surface temperature of the roller contactable with the toner image bearing side is maintained at a level not lower than the softening point of the toner forming the toner image. The heat source is not limited to the electric heater 3, but another suitable means may be used.

If the thin film 6 is peeled off the toner image bearing side of the transparent film 4 immediately after the toner image 5 is heated and pressed, that is, when during the binder is still soft, a part of the toner image tends to transfer onto the thin film 6, which is not desirable. For this reason, the thin film 6 is preferably peeled after the toner image 5 is cooled, that is, when the tackiness has decreased sufficiently.

Figure 4:
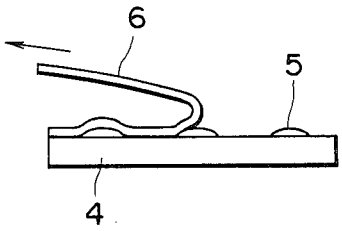
FIGS. 4 and 5 illustrate a peeling step in an embodiment of the present invention.

FIG. 4 shows the behavior the thin film 6 is peeled in the direction of an arrow with a sharp curvature, that is, with the small radius of curvature of the film 6. As to the preferable condition when the film 6 is peeled, the curvature of the thin film 6 is sharper than that of the transparent film 4 at a point where the thin film 6 is peeled off the toner image bearing side of the transparent film 4, irrespective of the way of peeling.

Figure 5:
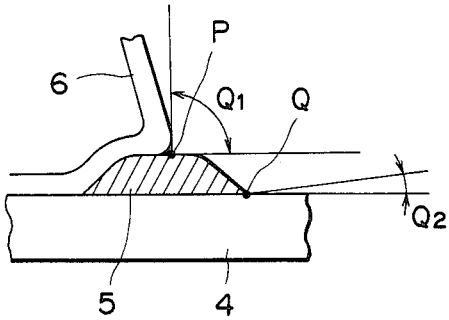

FIG. 5 illustrates more particularly the effect of the curvature. In this FIG., the thin film 6 is peeled off the toner image 5 of the transparent film 4, and an angle Q1 formed between the toner image 5 and the thin film 6 at the peeling point between the toner image 5 and the thin film 6 is larger than an angle Q2 formed between the transparent film 4 and the toner image 5 at the peeling point Q between the transparent film 4 and the toner image 5 (the edge of the image 5 bonded to the transparent sheet 5). Therefore, the peeling stresses at the peeling points have such a relation that the peeling stress at the point P is larger than the other, so that the toner image 5 is retained on the recording material, that is, the transparent film 4, while being separated from the thin film 6.

Thus, the improvement of the image achieved by the apparatus according to this embodiment is not disturbed by the peeling action.

When the thickness of the thin film overlaid on the transparent film 4 is the same as the thickness of the transparent film 4, or when the thickness of the thin film 6 is over 50 microns, the angle at the peeling point is not stabilized and varies at random. This can result in that the toner image is transferred or retained to the side where the peeling angle is smaller, or that a part of the toner image 5 on the transparent film 4 is transferred to the thin film 6. This has been confirmed in various experiments. Accordingly, the thickness of the film to be overaid on the transparent film 4 is preferably not more than 50 microns irrespective of the material thereof.

EXAMPLE 1

Using a copying machine for personal use PC-10, available from Canon Kabushiki Kaisha, Japan, a color image was formed on a transparent polyester film (OHP film available from Canon Kabushiki Kaisha) having a thickness of 75 microns. A polyester film having a thickness of 12 microns, 38 microns or 50 microns was overlaid on the toner image bearing side of the OHP film. Then, the OHP film with the polyester film was passed through the nip formed between the rollers 1 and 2 at a speed of 2 m/min. The surface temperature of the roller was 150° C. After the toner image cooled down, the polyester film (having a thickness of 12 microns, 38 microns or 50 microns) was peeled off the OHP film. The OHP film thus processed was projected on the screen, using 008 Portable Overhead Projector available from 3M, and it was confirmed that a fine and sharp color image was reproduced on the screen.

EXAMPLE 2

Similar experiments were conducted under the same conditions as in Example 1 with the exception that a polyimide film having the thickness of 12 microns, 38 microns or 50 microns was used instead of the polyester film. The projected image on the screen was fine and clear as in Example 1.

Figure 6:
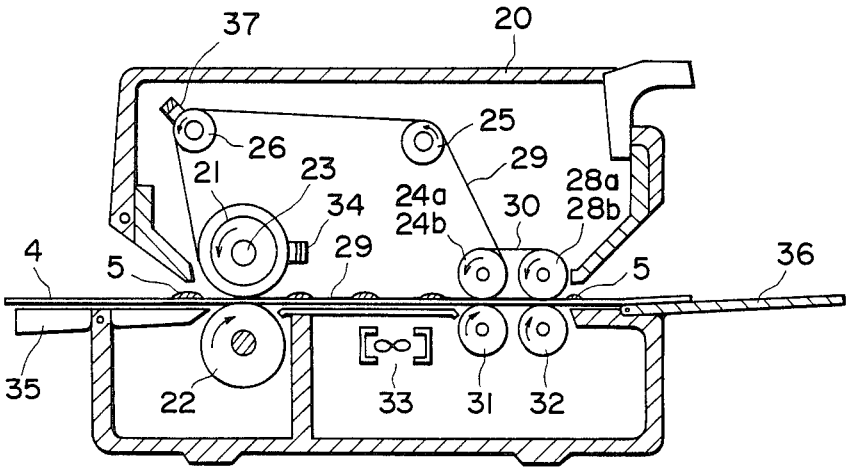
FIG. 6 is a sectional view of an apparatus according to another embodiment of the present invention.

FIG. 6 is a sectional view of an image quality improving apparatus according to another embodiment of the present invention, wherein the image quality improving apparatus 20 includes a heating roller 21 containing therein a heating source 23 which is effective to maintain the surface temperature of the roller 21 at a level not less than the toner softening point. The surface of the heating roller is of metal or rubber. The apparatus 20 further includes a pressing roller 22 which is press contacted to the heating roller 21 by a known pressing means. The surface of the pressing roller 22 is elastic and is made of rubber or the like.

Figure 8:
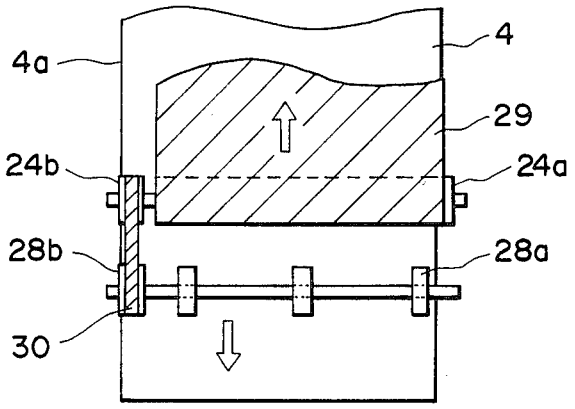
FIG. 8 is a partial top plan view of the apparatus of FIG. 6.

FIG. 8 is a top plan view of a major part of the apparatus shown in FIG. 6. As will be understood from FIGS. 6 and 8, a separation roller **24*a* is spaced from the heating roller 21 by the distance through which the image 5 heated by the heating roller 21 to the softening or fusing temperature is restored to a solidified state or by the distance corresponding to the time required for the heated image 5 to be cooled by a cooling fan 33. In this embodiment, the cooling fan 33 is provided between the heating roller 21, and the separation roller 24*a* to positively supply the cold air to the recording material transporting passage, in order to reduce the distance between the heating roller 21 and the separation roller 24*a***, which will be longer if the material air-cooling is employed.

A smooth processing sheet 29 is adapted to be closely contacted to the recording material 4 and the image 5 fixed thereon, and is stretched around the surface of the heating roller 21, the surface of the separating roller **24*a*, a tension roller 25 and a supporting roller 26 so as to be endlessly rotatable. The sheet 29 is of a nature of being slightly deformable by heat. A temperture sensor 34 detects the surface temperature of the heating roller 21, which is transmitted to an unshown control means which controls the power supply to the heating source 23 so as to maintain the surface temperature at such a level that the surface of the image 5 is softened or fused by the temperature with the aid of the pressure applied by the pressing roller 22**.

A separation roll **24*b* is adapted to abut the lateral edge of the recording material 4 to assist the separating operation of the separation roller 24*a*. A discharing roll 28*b* is effective to convey the recording material 4 to the discharge side. Between the discharge roll 28*b* and the separation roll 24*b*, a separation belt 30 is entrained. Discharging rollers 28*a* are fixed on the shaft to which the discharging roll 28*b* is fixed so that they are driven together. A transporting roller 31 is cooperative with the separation roller 24a. A discharge assisting roller 32 is cooperative with the discharging roll 28b and the discharging roller 28a. Adjacent the recording material inlet of the apparatus, there is an inlet guide 35. The apparatus further includes a cleaning member 37 which is contactable to the sheet 29 and is effective to press it against the supporting roller 26, thereby smoothing and also cleaning the sheet 29**.

In operation, a recording material 4 such as a copy having a fixed image 5 thereon, of which the operator deems it necessary to improve the image quality, is introduced into the apparatus 20 from the inlet guide 35. The recording material 4 reaches the nip between the heating roller 21 and the pressing roller 22. Here, the entire surface of the image 5 is covered by the sheet 29 with the aid of the resiliency of the pressing roller 22. Further, the recording material 4 receives the pressure by the rollers 21 and 22 and also receives the heat from the heating roller 21. This causes the surface of the image 5 to be softened, and promotes the close-contact of the sheet 29 to the surface of the image 5. The recording material 4 is passed through the nip with the sheet 29 close-contacted to the image 5, and it is cooled together with the toner image 5 by the air supplied by the cooling fan 33 below the softening point. Subsequently, the lateral end of the recording material 4 is separated from the sheet 29 by the separation belt 30. As shown in FIG. 8, the lateral end portion 4a of the recording material 4 is slightly offset from the sheet 29, thereby allowing the recording material 4 to be separated from the separating belt 30.

Figure 9:
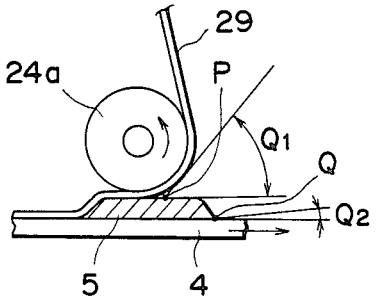
FIG. 9 illustrates the peeling in the apparatus of FIG. 6.

As shown in FIG. 9, after the toner is cooled, the sheet 29 is peeled off the recording material 4. The peeling operation is ensured by the curvature of the sheet 29 stronger than that of the recording material 4 at the peeling point P between the sheet 29 and the image 5 on the recording material. The stronger curvature of the sheet 29 is provided by the separation roller 24a, along the peripheral surface of which the sheet 29 extends.

Figure 10:
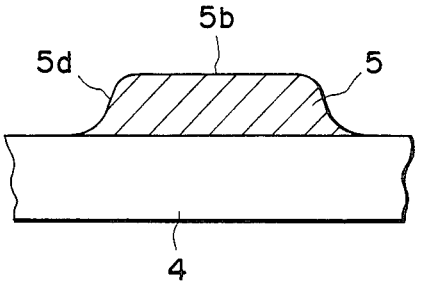
FIG. 10 is an enlarged sectional view of an image provided by an apparatus according to the present invention.

As shown in FIG. 10, the image 5 is reformed by passing through the apparatus 20. The top surface 5b of the toner image is uniform and smooth due to the smoothness of the processing surface of the processing sheet 29. Additionally, the edge 5d of the image is sharp, and the edge surface is also smooth. Therefore, a sharp and properly glossy image of high density, that is, a high quality image can be obtained.

Some examples of operation using the image quality improving apparatus 20 of FIG. 6 will be explained.

EXAMPLE 3

Using a personal use copying machine PC-25, available from Canon Kabushiki Kaisha, copy images were formed on an official (a Japanese Government) new year post card as the recording member 4 with black toner, red toner, blue toner or green toner. Characters and pictures were reproduced. Processing sheet 29 was a polyimide film of 12 microns thickness, and the surface temperature of the heating roller 21 was 155° C. with the total pressure of approximately 10 kg between the heating roller 21 and the pressing roller 22. The recording material was passed through the nip therebetween at the speed of 1 m/min. Then, sharp and properly glossy images were provided with the following image density:

TABLE 1

| | Before Processing | After Processing |
|---|---|---|
| Solid Black Image | 1.15 | 1.85 |
| Density (ϕ 5) | 1.36 | 2.03 |
| Solid Red Image Density | 1.42 | 1.80 |
| Solid Blue Image Density | 1.37 | 1.71 |
| Solid Green Image Density | 1.06 | 1.18 |

EXAMPLE 4

Other experiments were conducted under the same conditions as in Example 3 with the exception that the recording material 4 was a transparent sheet for Canon dry use, available form Canon Kabushiki Kaisha.

The copy image before the processing was such that when it is projected by an overhead projector, CABIN, A4-ATTA CHE, the red part, blue part and green part were not reproduced as those colors but were almost black. However, the copy image after the processing was reproduced with faithful colors. In the case of the transparent copy, the image density is not very important, but the density was measured as follows:

TABLE 2

| | Before Processing | After Processing |
|---|---|---|
| Solid Black Image Density (ϕ 5) | 1.42 | 2.11 |

Figure 7:
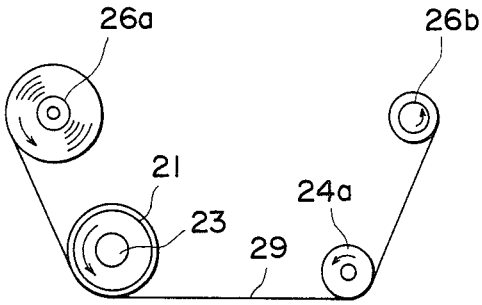
FIG. 7 illustrates a modification of a sheet feeder usable with the apparatus of FIG. 6.

As shown in FIG. 6, the processing sheet 29 is tensioned by the tension roll 25, and is cleaned by the cleaning pad member 37. Since the processing sheet 29 is not highly durable, the sheet 29 may be wound around a supply reel 26a and wound around a take-up reel 26b, between which the sheet 29 is used for the image quality improving processing, as shown in FIG. 7. In this case, the sheet 29 is used for the processing only once.

In the foregoing description, the embodiments have been described in which the image after being fixed is processed for image quality improvement. However, the present invention is not limited to this. A partly fixed (by pressure and/or by heat) image may be introduced in the apparatus 20 for example, with substantial advantages.

Figure 11:
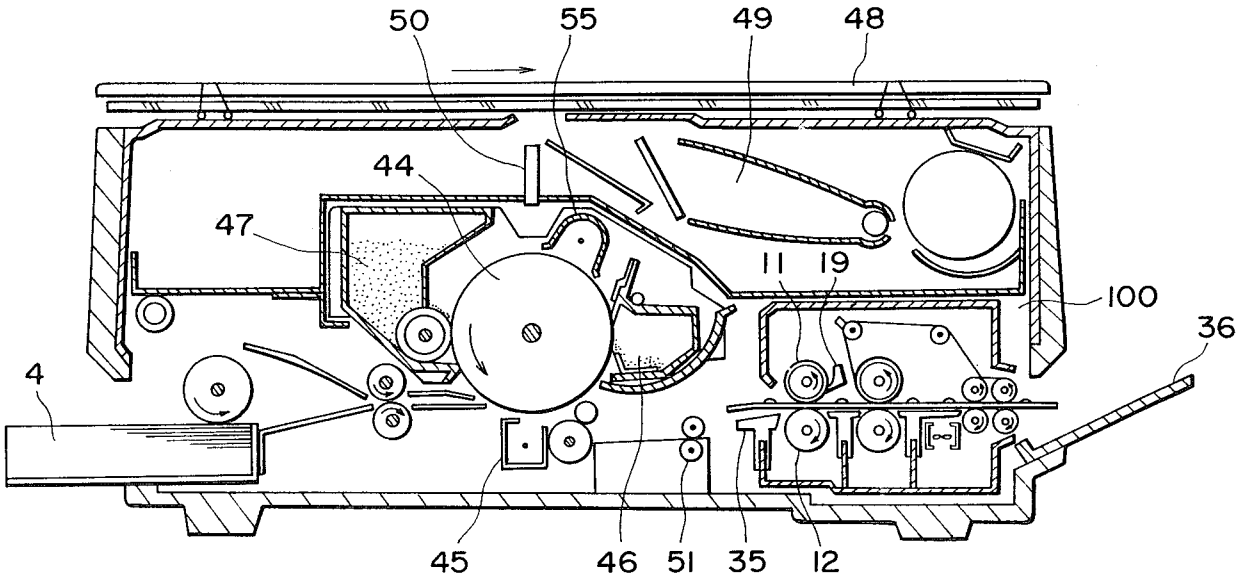
FIG. 11 is a sectional view of an image forming apparatus containing the image quality improving apparatus according to the present invention.
Figure 12:
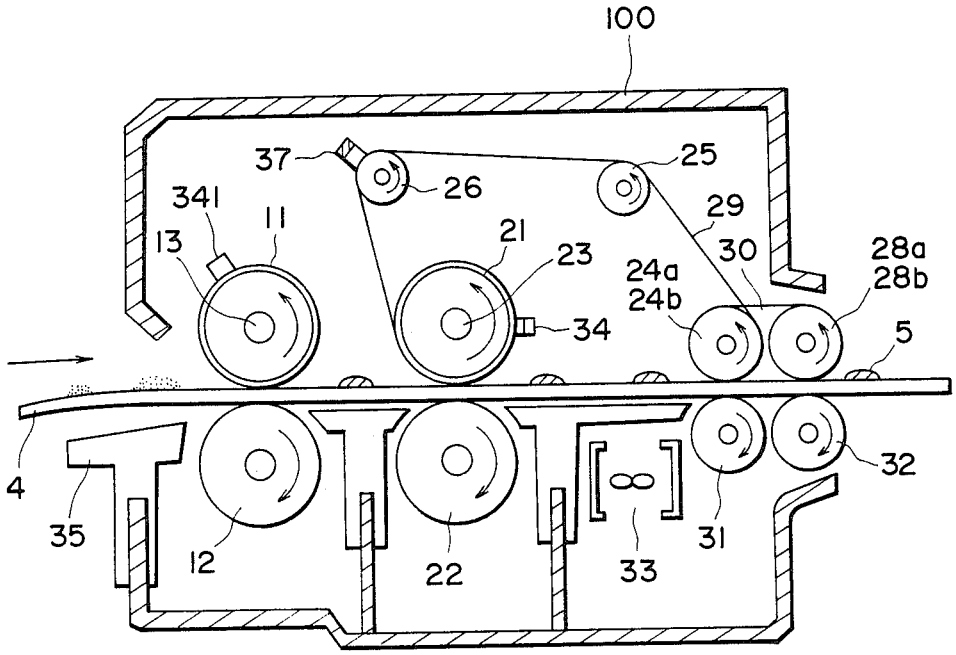
FIG. 12 is an enlarged sectional view of the image quality improving apparatus contained in the image forming ap of FIG. 11.

FIGS. 11 and 12 show another embodiment of the present invention wherein the image quality improving apparatus is incorporated in an image forming apparatus. In this embodiment, the image quality improving apparatus like the one shown in FIG. 6 is used with a general image forming apparatus.

As shown in FIG. 11, the image forming apparatus comprises a reciprocal original carriage 48 for carrying an original to be copied, an illumination optical system 49 for illuminating the original, an imaging optical system 50 for forming an image of the original and a photosensitive member 44 on which the image is formed. Around the photosensitive member 44, there are provided a corona charger for sensitizing the photosensitive member 55, a developing device 47 for visualizing a latent image of the original with the toner powder, an image transfer corona charger 45 for transferring the visualized image onto a recording material, a cleaner 46 for cleaning the surface of the photosensitive member 44 for the repeated use thereof. To supply the transfer material to the photosensitive member, a conveying roller 51 is provided. In operation, a latent image of the original is formed o the photosensitive member 44 through a known process and is developed by the developing device 47. The developed image is transferred onto the recording material 4 electrostatically. Then, the recording material 4 is conveyed to the image fixing device 100, which is shown in an enlarged scale in FIG. 12 wherein a separation pawl 19 for the fixing roller 11 shown in FIG. 11 is omitted.

The detailed description of the apparatus 100 is omitted for the sake of simplicity of explanation since the structure is essentially the same as of FIG. 6.

The fixing roller 11 is adapted to contact the unfixed toner image and is provided with a heating source 13 for heat-fixing the toner image. The temperature thereof is detected by a temperature sensor 341 producing an output representative of the temperature, in response to which an unshown temperature control means controls the heating source 13 to keep the temperature at substantially a constant level. The level of the temperature is so predetermined that the toner image is completely fixed or that the image is temporarily or partly fixed. The former level, that is, the complete fixing level has been found to be preferable from the standpoint of the degree of the improvement in the image quality. A pressing roller 12 is press contacted to the fixing roller 11 by an unshown pressing means and forms with the fixing roller 11 a nip therebetween. As for the structures for the fixing roller 11 and the pressing roller 12, any of known structures and suitable combinations thereof may be used. In this embodiment, the heat fixing type is employed, but a pressure-fixing type may be used, and in addition, hot plate fixing may be utilized.

In operation, when the recording material 4 having the toner image thereon is introduced into the fixing device 100, and the toner image 5 thereon is temporarily or completely fixed, while the recording material 4 is passing through the nip formed between the fixing roller 11 and the pressing roller 12. After the image is partly or completely fixed, the recording material is introduced to the nip formed between the heating roller 21 and the pressing roller 22 for the improvement in the image quality. As described hereinbefore, the pressure and the temperature in the couple of the image quality improving rollers are set so as to soften or fuse at least the surface of the image 5, with those results which have been described hereinbefore with reference to FIG. 6. In this embodiment, it is advantageous that the amount of heat applied by the rollers 21 and/or 22 to the recording material 4 can be reduced, since the fixing roller 11 is of heat-fixing type.

As described, the high quality of image can be provided by the apparatus according to the embodiment of FIG. 11. Further, this embodiment is advantageous in that the image quality improving process can be performed within the image forming apparatus, and therefore, the output production of the image forming apparatus can be improved in the image quality. The modification explained in conjunction with FIG. 7 is applicable to the apparatus of FIG. 11.

The embodiment of FIG. 12 may be modified by removing the rollers 11 and 12 for the image fixing and by using the heating roller 21 and the pressing roller 22 also as the image fixing roller 11 and the image fixing pressing roller 12. Such a modification of this embodiment will be described. Since the rollers 21 and 22 have to be effective also to fix the image, the sheet 29 directly contactable to the unfixed toner image 5 has a sufficient parting nature with respect to the unfixed toner image 5. Further, the temperature and the pressure have to be determined so as to fix the toner image on the recording material, that is, they must be enough to fuse the toner as in usual fixing devices. In this modified system wherein the image fixing and the image quality improving operation are performed simultaneously, the image quality is much improved as compared with the conventional images without the present invention.

The detailed Examples will be described with respect to FIG. 12 embodiment and the modification thereof.

As a comparison, two types of image fixing operations were performed, in one of which an image was fixed only by a single couple of the fixing roller 11 and the pressing roller 12, and in the other of which two couples of the rollers 11 and 12 are provided so as to heat-fix the same image twice.

The conveying speed of the recording material was 100 mm/sec., and the temperature of the rollers was 185° C. The pressure between the associated rollers in each couple of rollers was 30 g/mm. The surface of rollers 11 and 21 were coated with tetrafluoroethylene layer, and the surfaces of the pressing rollers were coated witlh silicone rubber layer. The processing sheet was polyimide film having the thickness of 12 microns. The density of the image was measured by MACBETH RD514 density meter. The results are shown in Table 3 below.

TABLE 3

| | SOLID BLACK IMAGE DENSITY (ϕ 5) | GLOSSINESS |
|---|---|---|
| SINGLE (FIXING, PRESSING) | 1.35 | NON |
| DOUBLE (FIXING, PRESSING, FIXING, PRESSING) | 1.40 | HARDLY GLOSSY |
| FIG. 12 EMBODIMENT | 1.60 | PROPERLY GLOSSY |
| MODIFIED EMBODIMENT | 1.50 | PROPERLY GLOSSY |

As will be understood form the results shown in Table 3, the image provided by the apparatus of the present invention is of high quality which is not provided by the conventional devices.

Figure 13:
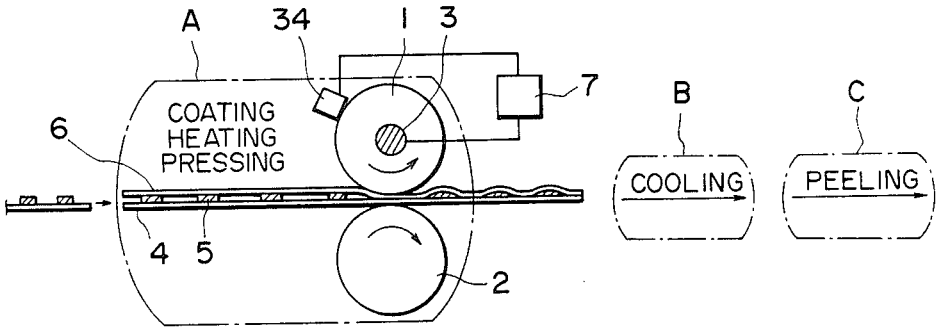
FIG. 13 is a schematical illustration of the image quality improving method.

FIG. 13 illustrate the process used with the present invention in a summarized manner.

The process is incorporated in the devices described in the foregoing embodiments. As shown, the process includes a step A wherein the recording material is covered or coated by the processing sheet and heated and pressed, and includes a cooling step B and a peeling step C.

In step A, the recording material 4 bearing the image 5 is coated with a smooth sheet 6 at the image bearing side of the recording sheet 4, and then, introduced into the nip between the rollers 1 and 2. By the nip, the recording material 4 and the sheet 6 are pressed together. In the nip, the sheet 6 and the surface of the image is heated by the surface of the roller 1 so that the sheet 6 and the surface of the image 5 are heated to a level higher than the toner softening or fusing point but less than the fusing point of the sheet 6 material. When the image is pressed through the sheet 6, the sheet 6 follows the surface of the image, and simultaneously the toner particles are condensed at a higher density.

In the cooling step B, the sheet 6 and the image 5 surface are is cooled by natural heat release or by enforced air-cooling so as to restore the entire image to the solid state. At that time, the sheet 6 is contacted closely to the surface of the image so that the sheet 6 determines the state of the toner surface.

In the peeling step C, the sheet 6 is peeled off the image 5. After this, the image on the recording sheet 4 is improved. It is important to peel the sheet 6 after the cooling step B from the standpoint of avoiding disturbance of the image under the sheet 6 which has been improved in quality.

The image 5 which has been processed by the steps A, B and C, is more condensed and integral without cavity; the edge surface 5*d* and the top surface 5*b* are smooth and uniform whereby the image is improved, having a sufficient sharpness, proper gloss and sufficient density. Those qualities of the image have not been achieved by conventional copying machines.

Detailed Examples of the processing sheets usable with the apparatus and the method of the present invention will be described in conjunction with FIGS. 14–19. With the decrease of the thickness of the sheet 6, it becomes more difficult to correctly overlay the sheet 6 on the recording material, and the sheet 6 is more easily wrinkled.

Further, if the leading edge of the thin sheet 6 is beyond the leading edge of the recording material, the sheet 6 can be wound around the roller 1 after passing through the nip between the rollers 1 and 2. Furthermore, if a thin film sheet is used repeatedly, it can be electrostatically charged so that it is difficult to handle.

Figure 14:
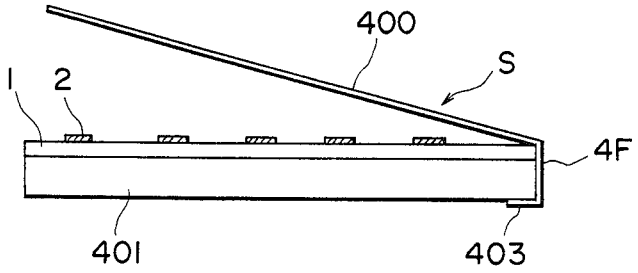
FIGS. 14–19 show various embodiments of a recording material processing sheet according to the present invention.
Figure 15:
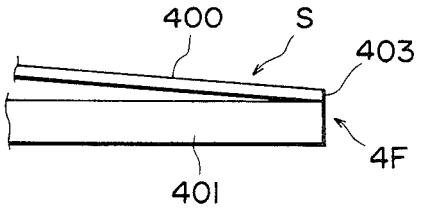
Figure 16:
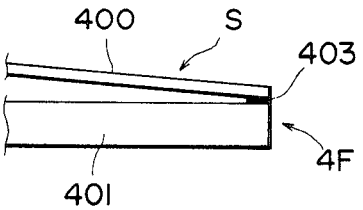
Figure 17:
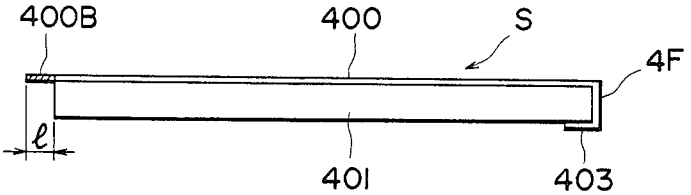
Figure 18:
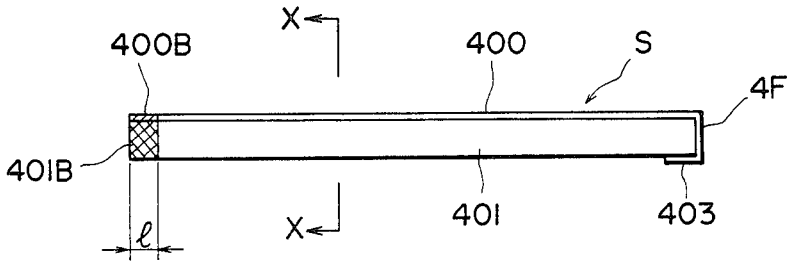

As shown in FIGS. 14–18, the processing sheet S comprises a thin film 400, preferably a transparent thin film, and a mount 401 for supporting the recording material. The mount may be a thicker film. The thin film 400 and the mount 401 are bonded at the bonding portion 403. In the examples of FIGS. 14, 17 and 18, the film 400 covers the leading edge portion 4F of the mount 401 at the top surface and turns around the edge to over the leading end surface and the bottom surface as shown in the respective Figures. At the bottom surface of the mount 401, the film 400 is bonded to the mount 401. In the sheet S shown in FIG. 15, the edge of the film 400 and the leading end surface 4F of the mount 401 are bonded by a sealing member 403. In FIG. 16, the film 400 is bonded to the top surface (recording material supporting surface) of the mount 401 at the portion indicated by a reference 403.

Those processing sheets S are advantageous as follows. Since the mount 401 is fixed at an end 4F to the film 400, then the thin film 400, the image 2 and the recording material 1 are overlaid in the correct order simply by sandwiching a copy sheet produced by an electrophotographic copying machine for example between the thin film 400 and the mount 401. It can be avoided that the thin film 400 is offset or wrinkled upon the overlaying. Since the recording material 1 is supported by the mount 401, it can be taken out without being wound around the roller. Because of the structure of the processing sheet S wherein the thin film is bonded at one edge to the mount which is the base for supporting the recording material, the handling of the recording material and the processing sheet is much improved.

Figure 19:
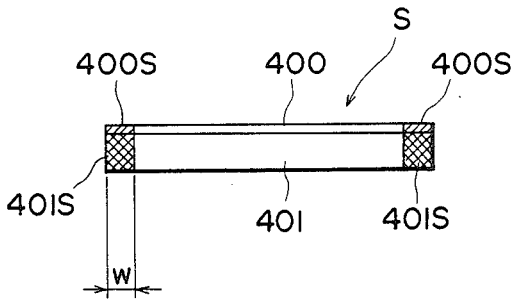

In FIGS. 17, 18 and 19, there are shown processing sheets S in which the film 400 is easily peeled off the image. This will be explained together with FIGS. 20–22. The thin film is larger in size than the recording sheet and is fixed to a mount at an end thereof. The recording sheet is sandwiched between the thin film and the mount with the image of the recording material contacted by the thin film. The recording sheet is pressed and heated together with the thin film so that the surface of the image is fused. Then, the image is cooled, and the processing sheet is separated from the recording material.

The relation among the thin film, the mounting sheet and the recording material will be described. The thin film 400 of FIG. 17 is longer than the mounting sheet so that the trailing edge 400B of the thin film 400 is beyond the trailing edge of the mounting sheet 401 by the length 1. Since the size of the mounting sheet 401 is predetermined so that it can support the recording material 1, the thin film 400 is longer than the recording material 1. The length difference 1 is indicated in FIG. 17 by hatched portions of the thin film 400. The length difference 1 is preferably not less than 1 mm when the thin film is contacted to the image surface and is heated. Practically, the length difference is 1 mm–10 mm when it is not contacted to the image surface, although the length difference slightly changes depending on the material of the thin film. This dimension is satisfactory even if the size of the recording sheet is a the same as that of the mount 3. Too large of length difference is not preferable from the standpoint of suitable conveyance of the sheet and the influence of the heat loss.

In FIG. 18, the mount 401 is made longer by the length by which the thin film 400 is longer than the recording material. In this case, it is preferable that the thin film 400 is less adhesive to the mount 401, since then the easiness of the separation is increased. This is effective to maintain the easily separable state between the film 400 and the mount 401 in the area corresponding to the difference in length between the recording material and the thin film 400 so that the disturbance in that area can be avoided.

In FIG. 18 embodiment, the width of the thin film 400 is larger than the recording material so that the lateral ends 400S of the thin film 400 is beyond the lateral edges of the recording sheet by W, as shown in FIG. 19 which is a cross-sectional view taken along X—X of FIG. 18. Further, in this embodiment, the mount 401 is also larger than the recording material and has the same width as the thin film, thus protecting the thin film.

As will be understood from the foregoing description, the difference in size includes the length difference, width difference or the combination thereof. The difference is preferably 1 mm–10 mm when separated from the recording material.

As described, the dimensional difference between the recording sheet and the thin film is effective to make the handling thereof easier, when the thin film is peeled off the image which has been improved in the image quality, whereby it can be avoided that the surface of the improved image is disturbed when the thin film is separated therefrom.

Figure 20:
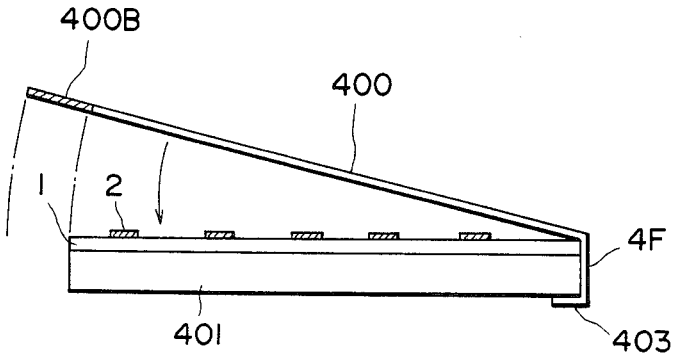
FIGS. 20–22 illustrate the method using the processing sheets of FIGS. 14–19 according to the present invention.
Figure 21:
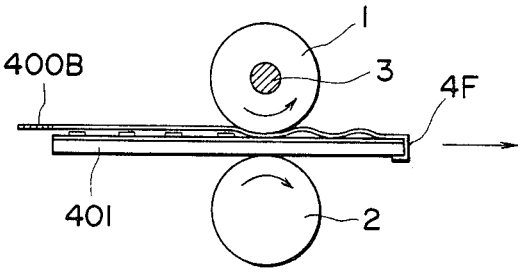
Figure 22:
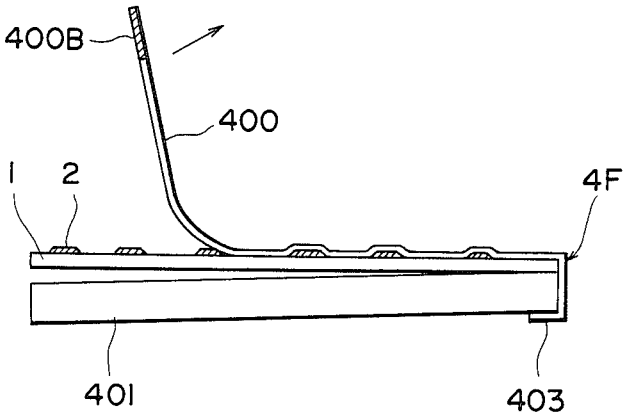

FIGS. 20–22 illustrate the operation using the processing sheet shown in FIG. 17. The rollers 1 and 2 of FIG. 21 are the same as the rollers 1 and 2 described in conjunction with FIG. 1. In this embodiment, a transparent film is used as the recording material 1, the transparent film bearing a color image formed with different color toner particles. As shown in FIG. 20, the transparent film 1 is sandwiched between the mount 401 and the thin film 400 with the leading edge of the transparent film 1 abutting the leading end portion 4F of the mount 401, so that the thin film 400 is then overlaid on the color image. As shown in FIG. 21, the leading edge 4F of the processing sheet is introduced into the nip formed between the rollers 1 and 2 together with the recording sheet. In the nip, the surface of the color image on the thin film is fused. After the color image 5 on the transparent film is cooled, or after the tackiness of the toner is decreased, the thin film 400 is peeled off the image by drawing the trailing edge 400B in the direction shown by an arrow in FIG. 22. FIG. 22 illustrates the peeling step. The transparent copy with non-black toner is projected as a fine and sharp color image.

Since the size of the tin film is larger than that of the recording material or than that of the sheet bearing thereon an image which is subjected to the image quality improving operation, the peeling operation is made easier, with the result that the improved quality of the image can be provided with certainty.

The present invention is particularly advantageous when the recording sheet is a resin sheet such as transparent film. The transparent film 1 is of, for example, a polyester film having a thickness of 12–200 microns. However, from the standpoint of easy handlng, the thickness of 50–120 microns is preferable. The processing transparent sheet 400 is preferably thinner than the transparent film 1.

The processing sheets 6, 29 and 400 cover the entire surface of the fixed or partly fixed toner image on the recording material and are subjected to the heat, and therefore, the sheets are of heat resistive nature, more particularly, they have a fusing temperature higher than the fusing point of the toner image. In addition, the sheets 6, 29 and 400 have enough flexibility to follow the projections of the image substance, more particularly, they are freely flexible to laminate in compliance with the projections of the image by heat without tension.

When the sheet 6, 29 or 400 is of resin, the resin is preferably different from the resin constituting the toner to be used for forming the fixed image, since it will improve the easiness of feeling the sheet 6, 29 or 400 from the image. More particularly, the sheet 6, 29 or 400 is of a polyimide film or polyester film or the like. The thickness thereof is preferably not more than 50 microns, more preferably, approximately 25 microns. The average surface roughness of the sheet 6, 29 or 400 at the surface contactable to the image is not more than 10 microns and preferably not more than 0.1 microns.

The heating source is not limited to the heater 3 provided inside the roller. An external heater, heat pipe, PTC ceramic heater or the like may be used in place thereof. The rollers may be replaced by belts or pressing plates, although it is preferable to use pressing means having a resiliency to accomplish the close contact between the toner image and the processing sheet.

The present invention includes any combination of the above-described structures.

As for the method of forming the toner image 5 on the transparent film as the recording material, an electrophotographic process and electrostatic printing process are generally usable, but the invention is not limited to those processes, and other processes are acceptable if the toner image can be formed on the transparent film. As for the toner, the toner usable with the above-mentioned processes, that is, the toner having a binder in which dye, pigment and the other additives are dispersed and mixed. The toner can contain magnetic materials if the amount, the particle size and the material thereof are such that they do not impede the light transmitting therethrough.

While the invention has been described with reference to the structures disclosed herein, it is not confined to the details set forth and this application is intended to cover such modifications or changes as may come within the purposes of the improvements or the scope of the following claims.

What is claimed is:

1. A process of improving a quality of a toner image fixed on a recording amterial, comprising the steps of:

overlaying a processing sheet on a fixed image bearing side of the recording material to cover the fixed toner image with the processing sheet, and heating and pressing the recording material and said processing sheet to fuse the image adjacent to the processing sheet; and peeling the processing sheet off the recording material after the image is sufficiently cooled to provide a toner image which is condensed and which has been smoothed at the surface thereof.

2. A process according to claim 1, wherein the processing sheet is a resin sheet of a thickness of not more than 50 microns.

3. A process according to claim 1 wherein the recording material is a transparent film having a thickness larger than that of the processing sheet, and wherein the image formed thereon is a color image formed with different color toner particles.

4. A process according to claim 1, wherein the processing sheet includes a resin film and a mounting sheet for supporting thereon the recording material, the resin film and the mounting sheet being bonded adjacent an end of the mounting sheet and the resin film being contactable with the fixed toner image on the recording material when the recording material is supported on the mounting sheet.

5. A process of improving a quality of a toner image formed on a recording material comprising the steps of:

overlaying a processing sheet on an image bearing side of the recording material to cover the toner image with the processing sheet, and heating and pressing the recording material and said processing sheet to fuse the toner image adjacent to the processing sheet; and peeling the processing sheet off the recording material after the image is sufficiently cooled to provide a toner image which is condensed and which has been smoothed at the surface thereof;

wherein the processing sheet is a thin resin film and is fixed to a mounting sheet adjacent an edge thereof, wherein the recording material is sandwiched between the processing sheet and the mounting sheet, and the processing sheet is pressed and heated form said edge side.

6. A process according to claim 5, wherein the processing sheet has a length longer than that of the recording material.

7. A process according to claim 5, wherein the processing sheet and the mounting sheet are longer and wider than the recording material.

8. A process according to claim 5, wherein the processing sheet has an average surface roughness not more than 10 microns at its side contactable with the image on the recording material, and has a thickness not more than 50 microns.

9. An image quality improving apparatus for improving the quality of an image fixed on a recording material, comprising:

a processing sheet contactable with the fixed image on the recording material;

means for pressing said processing sheet to the fixed image bearing side of the recording material to closely contact it;

means for applying heat to the fixed image to soften or fuse a surface of the fixed image while said processing sheet is being pressed and contacted to the fixed image; and means for peeling said processing sheet off the fixed image surface after the fixed image heated by said heating means is restored to a solid state.

10. An apparatus according to claim 9, wherein said processing sheet is a resin film of a thickness of not more than 50 microns.

11. An apparatus according to claim 9, wherein the fixed image is formed with different color toner particles and the recording material is a resin material.

12. An apparatus according to claim 11, wherein said processing sheet is not more than 50 microns in thickness and is thinner than the recording material.

13. An apparatus according to claim 9, wherein said processing sheet has an average surface roughness not more than 10 microns at the side contactable to the fixed image on the recording material.

14. An apparatus according to claim 13, wherein said processing sheet has an average surface roughness not more than 0.1 micron at its side contactable to the fixed image on the recording material.

15. An apparatus according to claim 9, wherein said processing sheet includes a resin film and a mounting sheet for supporting thereon the recording material, the resin film and the mounting sheet being bonded adjacent an end of the mounting sheet and resin film being contactable with the fixed image on the recording material when the recording material is supported on said mounting sheet.

16. An image quality improving apparatus usable with an image forming apparatus, comprising:

means for fixing a visualized image on a recording material;

a processing sheet contactable with the fixed image on the recording material;

means for pressing said processing sheet to the fixed image bearing side of the recording material to closely contact said processing sheet thereto;

means for applying heat to the fixed image to soften or fuse a surface of the fixed image while said processing sheet is being pressed and contacted to the fixed image; and means for peeling said processing sheet off the fixed image surface after the fixed image heated by said heating means is restored to a solid state.

17. An apparatus according to claim 9 or 16, wherein said pressing means includes a pair of rotatable members to grip said processing sheet and the recording material and convey them therebetween.

18. An apparatus according to claim 17, wherein said heating means heats the rotatable member which is opposed to the fixed image.

* * * * *

UNITED STATES PATENT AND TRADEMARK OFFICE

CERTIFICATE OF CORRECTION

PATENT NO. : 4,780,742

DATED : October 25, 1988

INVENTOR(S) : YASUSHI TAKAHASHI ET AL.

It is certified that error appears in the above-identified patent and that said Letters Patent is hereby corrected as shown below:

COLUMN 1

Line 38, "nal More" should read --nal. More--.

COLUMN 2

Line 12, "in a quality" should read --in quality--.
Line 23, "a quality" should read --the quality--.

COLUMN 3

Line 3, "ap" should read --apparatus--.
Line 51, "remaining the" should read --remaining among the--.

COLUMN 4

Line 52, "5" should be deleted.
Line 62, "if" should read --. If--.

COLUMN 5

Line 16, "during" should be deleted.
Line 22, "behavior" should read --behavior when--.
Line 58, "overaid" should read --overlaid--.

COLUMN 9

Line 1, "o" should read --on--.
Line 35, "and" should be deleted.

UNITED STATES PATENT AND TRADEMARK OFFICE

CERTIFICATE OF CORRECTION

PATENT NO. : 4,780,742

DATED : October 25, 1988

INVENTOR(S) : YASUSHI TAKAHASHI ET AL.

It is certified that error appears in the above-identified patent and that said Letters Patent is hereby corrected as shown below:

COLUMN 10

Line 23, "witlh" should read --with--.
Line 60, "is" should read --are--.
Line 68, "is" should be deleted.

COLUMN 12

Line 23, "a" should read --almost--.

COLUMN 13

Line 27, "the" should be deleted.
Line 39, "feeling" should read --peeling--.
Line 65, "that is, the" should read --is--.

COLUMN 14

Line 11, "amterial," should read --material,--.
Line 55, "form" should read --from--.

UNITED STATES PATENT AND TRADEMARK OFFICE

CERTIFICATE OF CORRECTION

PATENT NO. : 4,780,742

DATED : October 25, 1988

INVENTOR(S) : YASUSHI TAKAHASHI ET AL.

It is certified that error appears in the above-identified patent and that said Letters Patent is hereby corrected as shown below:

COLUMN 16

Line 5, "and resin" should read --and the resin--.

Signed and Sealed this

Fifteenth Day of May, 1990

*Attest:*

*Attesting Officer*

HARRY F. MANBECK, JR.

*Commissioner of Patents and Trademarks*